US008879968B2

(12) United States Patent
Takahashi et al.

(10) Patent No.: US 8,879,968 B2
(45) Date of Patent: Nov. 4, 2014

(54) IMAGE FORMING APPARATUS INCLUDING A CORRECTION FUNCTION FOR DEVIATION OF AN ENDLESS BELT

(75) Inventors: Masaaki Takahashi, Kanagawa (JP); Yasuhiro Shimada, Kanagawa (JP); Takashi Hoshino, Kanagawa (JP); Koichi Sato, Kanagawa (JP); Kazutoshi Sugitani, Kanagawa (JP); Yusuke Sakai, Kanagawa (JP); Koji Deguchi, Kanagawa (JP); Kazuyoshi Hagiwara, Kazuyoshi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 13/399,380

(22) Filed: Feb. 17, 2012

(65) Prior Publication Data

US 2013/0064579 A1 Mar. 14, 2013

(30) Foreign Application Priority Data

Sep. 12, 2011 (JP) ..... 2011-197894

(51) Int. Cl.
*G03G 15/01* (2006.01)
*G03G 15/00* (2006.01)

(52) U.S. Cl.
CPC ..... *G04G 15/1615* (2013.01); *G03G 15/0131* (2013.01); *G03G 2215/00156* (2013.01)
USPC ..... 399/301; 399/165

(58) Field of Classification Search
CPC G03G 15/755; G03G 15/754; G03G 15/1615
USPC ..... 399/301, 165, 302, 303
See application file for complete search history.

(56) References Cited

U.S. PATENT DOCUMENTS

| | | | | |
|---|---|---|---|---|
| 2004/0013451 | A1* | 1/2004 | Fukao et al. | 399/301 |
| 2009/0074479 | A1* | 3/2009 | Kamijo et al. | 399/308 |
| 2009/0087231 | A1 | 4/2009 | Masaki et al. | |
| 2009/0148198 | A1* | 6/2009 | Suzuki et al. | 399/301 |
| 2009/0317108 | A1* | 12/2009 | Taki et al. | 399/66 |
| 2010/0247174 | A1 | 9/2010 | Hori et al. | |

FOREIGN PATENT DOCUMENTS

| | | | |
|---|---|---|---|
| JP | 2004-347880 | A | 12/2004 |
| JP | 2007-011107 | A | 1/2007 |
| JP | 2009-086463 | A | 4/2009 |
| JP | 2009-251322 | A | 10/2009 |
| JP | 2010-231112 | A | 10/2010 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

An image forming apparatus includes an image bearing member, a medium transport member, an image transfer member, a first detection member detecting widthwise deviation of the image bearing member, a first deviation correcting member tiltable relative to the width direction and supporting the image bearing member, a first correction control section tilting the first deviation correcting member to correct deviation of the image bearing member, a second detection member detecting widthwise deviation of the transport member, a second deviation correcting member tiltable relative to the width direction and supporting the transport member, and a second correction control section tilting the second deviation correcting member to correct deviation of the transport member.

4 Claims, 7 Drawing Sheets

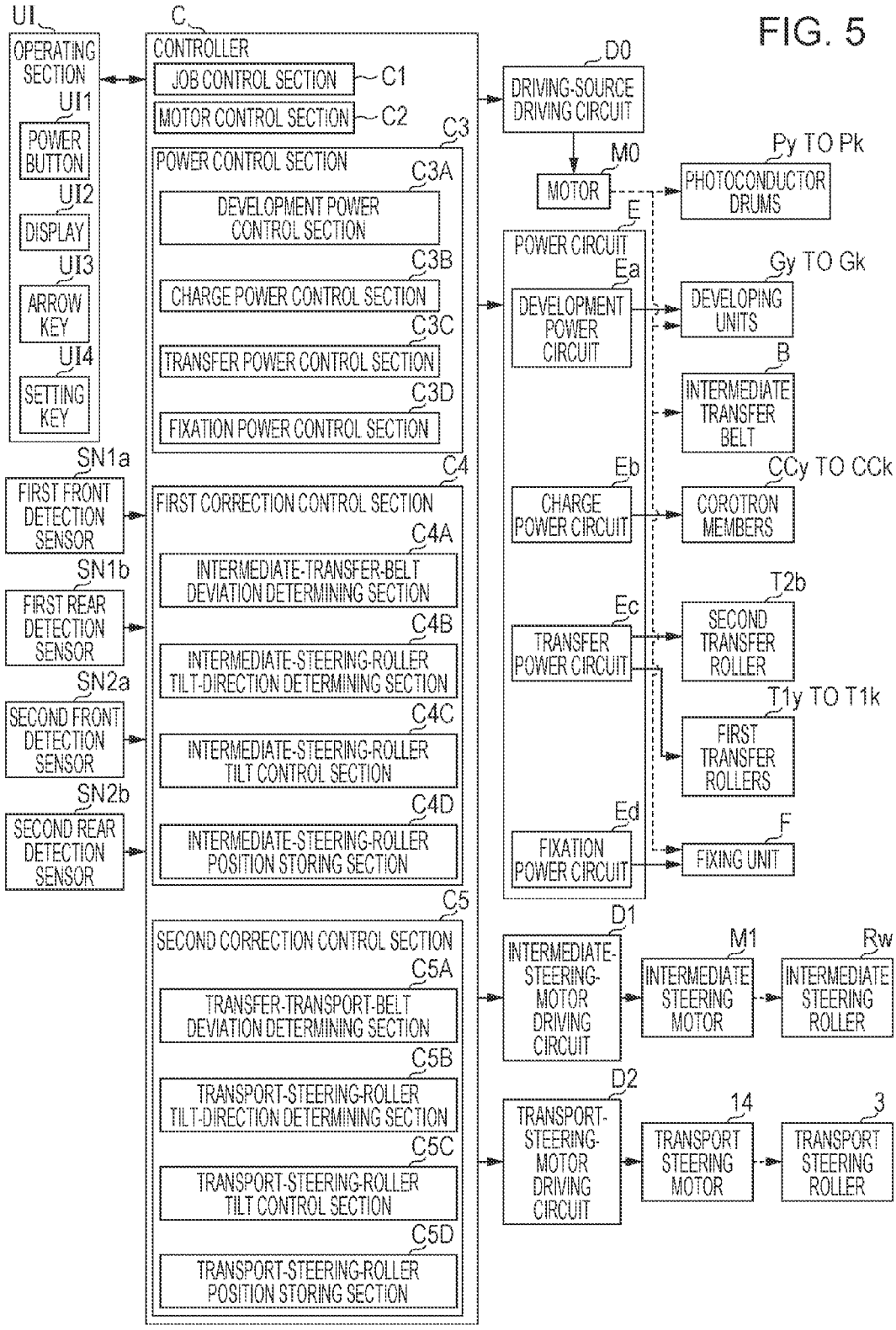
FIG. 5
UI
OPERATING SECTION
UI1
POWER BUTTON
UI2
DISPLAY
UI3
ARROW KEY
UI4
SETTING KEY
C
CONTROLLER
JOB CONTROL SECTION
C1
MOTOR CONTROL SECTION
C2
C3
POWER CONTROL SECTION
C3A
DEVELOPMENT POWER CONTROL SECTION
C3B
CHARGE POWER CONTROL SECTION
C3C
TRANSFER POWER CONTROL SECTION
C3D
FIXATION POWER CONTROL SECTION
C4
FIRST CORRECTION CONTROL SECTION
C4A
INTERMEDIATE-TRANSFER-BELT DEVIATION DETERMINING SECTION
C4B
INTERMEDIATE-STEERING-ROLLER TILT-DIRECTION DETERMINING SECTION
C4C
INTERMEDIATE-STEERING-ROLLER TILT CONTROL SECTION
C4D
INTERMEDIATE-STEERING-ROLLER POSITION STORING SECTION
C5
SECOND CORRECTION CONTROL SECTION
C5A
TRANSFER-TRANSPORT-BELT DEVIATION DETERMINING SECTION
C5B
TRANSPORT-STEERING-ROLLER TILT-DIRECTION DETERMINING SECTION
C5C
TRANSPORT-STEERING-ROLLER TILT CONTROL SECTION
C5D
TRANSPORT-STEERING-ROLLER POSITION STORING SECTION
SN1a
FIRST FRONT DETECTION SENSOR
SN1b
FIRST REAR DETECTION SENSOR
SN2a
SECOND FRONT DETECTION SENSOR
SN2b
SECOND REAR DETECTION SENSOR
D0
DRIVING-SOURCE DRIVING CIRCUIT
M0
MOTOR
Py TO Pk
PHOTOCONDUCTOR DRUMS
E
POWER CIRCUIT
Ea
DEVELOPMENT POWER CIRCUIT
Gy TO Gk
DEVELOPING UNITS
B
INTERMEDIATE TRANSFER BELT
Eb
CHARGE POWER CIRCUIT
CCy TO CCk
COROTRON MEMBERS
Ec
TRANSFER POWER CIRCUIT
T2b
SECOND TRANSFER ROLLER
T1y TO T1k
FIRST TRANSFER ROLLERS
Ed
FIXATION POWER CIRCUIT
F
FIXING UNIT
D1
INTERMEDIATE-STEERING-MOTOR DRIVING CIRCUIT
M1
INTERMEDIATE STEERING MOTOR
Rw
INTERMEDIATE STEERING ROLLER
D2
TRANSPORT-STEERING-MOTOR DRIVING CIRCUIT
14
TRANSPORT STEERING MOTOR
3
TRANSPORT STEERING ROLLER

IMAGE FORMING APPARATUS INCLUDING A CORRECTION FUNCTION FOR DEVIATION OF AN ENDLESS BELT

CROSS-REFERENCE TO RELATED APPLICATIONS

This application is based on and claims priority under 35 USC 119 from Japanese Patent Application No. 2011-197894 filed Sep. 12, 2011.

BACKGROUND

(i) Technical Field

The present invention relates to image forming apparatuses.

SUMMARY

According to an aspect of the invention, there is provided an image forming apparatus including an endless-belt-like image bearing member, an endless-belt-like transport member, a transfer member, a first detection member, a first deviation correcting member, a first correction control section, a second detection member, a second deviation correcting member, and a second correction control section. The endless-belt-like image bearing member rotates while bearing a visible image on a surface thereof. The endless-belt-like transport member is disposed in a transfer region where the visible image on the surface of the image bearing member is transferred onto a medium. Moreover, the endless-belt-like transport member transports the medium while supporting the medium on a surface of the transport member. The transfer member rotatably supports the endless-belt-like transport member and is disposed in the transfer region so as to face the image bearing member with the endless-belt-like transport member interposed therebetween. Transfer voltage used for transferring the visible image on the surface of the image bearing member onto the medium is applied between the transfer member and the image bearing member. The first detection member detects deviation of the endless-belt-like image bearing member in a width direction thereof. The first deviation correcting member extends in the width direction of the endless-belt-like image bearing member and is supported in a tiltable manner relative to the width direction. Moreover, the first deviation correcting member supports the endless-belt-like image bearing member. The first correction control section tilts the first deviation correcting member in a direction for correcting deviation of the image bearing member, if the first detection member detects that the image bearing member is deviated, so as to correct the deviation. The second detection member detects deviation of the endless-belt-like transport member in a width direction thereof. The second deviation correcting member extends in the width direction of the endless-belt-like transport member and is supported in a tiltable manner relative to the width direction. Moreover, the second deviation correcting member supports the endless-belt-like transport member. The second correction control section tilts the second deviation correcting member in a direction for correcting deviation of the transport member, if the second detection member detects that the transport member is deviated, so as to correct the deviation. An amount by which the image bearing member is moved per unit time in the width direction when the first deviation correcting member is tilted is set to be larger than an amount by which the transport member is moved per unit time in the width direction when the second deviation correcting member is tilted.

BRIEF DESCRIPTION OF THE DRAWINGS

Exemplary embodiment(s) of the present invention will be described in detail based on the following figures, wherein:

FIG. 5 is a functional diagram, that is, a block diagram, of a controller of the image forming apparatus according to the first exemplary embodiment of the present invention;

DETAILED DESCRIPTION

Figure 1:
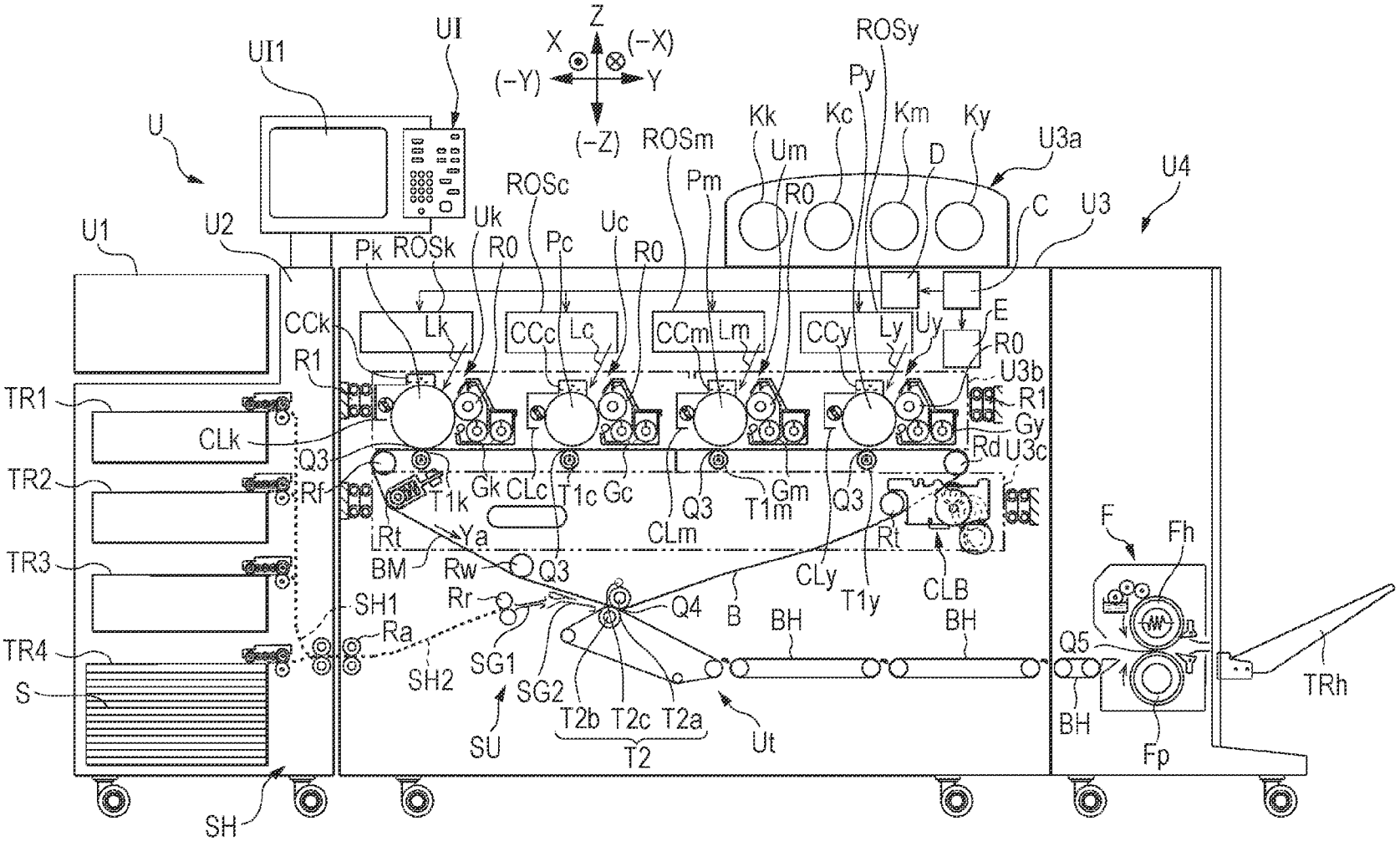
FIG. 1 is an overall view of an image forming apparatus according to a first exemplary embodiment of the present invention.

Although exemplary embodiments of the present invention will be described in detail below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 is an overall view of an image forming apparatus according to a first exemplary embodiment of the present invention.

Referring to FIG. 1, an image forming apparatus U includes an operating section UI, a scanner U1 serving as an example of an image reader, a feeding device U2, an image forming apparatus body U3, and a sheet output unit U4.

The operating section UI includes a power button, a copy start key, a number-of-copies setting key, and a numerical keypad that serve as an example of an input section, and a display.

The scanner U1 reads a document (not shown) and converts it into image information, and then inputs the image information to the image forming apparatus body U3.

The feeding device U2 includes multiple feed trays TR1 to TR4 as an example of feeders, and a feed path SH1 along which recording paper S serving as an example of a medium accommodated in each of the feed trays TR1 to TR4 is transported toward the image forming apparatus body U3.

Referring to FIG. 1, the image forming apparatus body U3 includes a controller C and a power circuit E that is controlled by the controller C so as to supply power to each component in the image forming apparatus body U3. The controller C receives the image information of the document read by the scanner U1 as well as image information transmitted from a personal computer serving as an example of an information transmission apparatus (not shown) connected to the image forming apparatus U.

The controller C processes the received image information to printing information for yellow (Y), magenta (M), cyan (C), and black (K) colors and outputs the information to a laser driving circuit D serving as an example of a driving circuit for a latent-image writing unit. The laser driving circuit D outputs laser driving signals input from the controller C to latent-image forming units ROSy, ROSm, ROSc, and ROSk for the respective colors at a predetermined timing.

Image bearing units Uy, Um, Uc, and Uk for the Y, M, C, and K colors are disposed below the latent-image forming units ROSy, ROSm, ROSc, and ROSk, respectively.

Referring to FIG. 1, the black-image bearing unit Uk includes a photoconductor drum Pk serving as an example of an image bearing member, a corotron member CCk serving as an example of a charger, and a photoconductor cleaner CLk serving as an example of an image-bearing-member cleaner. Likewise, the image bearing units Uy, Um, and Uc for the remaining colors Y, M, and C respectively include photoconductor drums Py, Pm, and Pc, corotron members CCy, CCm, and CCc, and photoconductor cleaners CLy, CLm, and CLc.

In the first exemplary embodiment, the photoconductor drum Pk for the K color, which is frequently used and thus often experiences surface abrasion, is given a larger diameter than the photoconductor drums Py, Pm, and Pc for the remaining colors so as to allow for high-speed rotation and a longer lifespan.

The photoconductor drums Py, Pm, Pc, and Pk are electrostatically charged by the corotron members CCy, CCm, CCc, and CCk, respectively, and electrostatic latent images are subsequently formed on the surfaces thereof by laser beams Ly, Lm, Lc, and Lk output as an example of latent-image write-in light from the latent-image forming units ROSy, ROSm, ROSc, and ROSk. Developing rollers RO provided as an example of developing members in developing units Gy, Gm, Gc, and Gk develop the electrostatic latent images on the surfaces of the photoconductor drums Py, Pm, Pc, and Pk into toner images, as an example of visible images, by using Y, M, C, and K developers.

In first transfer regions Q3, the toner images on the surfaces of the photoconductor drums Py, Pm, Pc, and Pk are sequentially superposed and transferred onto an intermediate transfer belt B, which is an intermediate transfer body serving as an example of an endless-belt-like image bearing member, by first transfer rollers T1*y*, T1*m*, T1*c*, and T1*k* serving as an example of a first transfer unit, whereby a multi-color image, that is, a color image, is formed on the intermediate transfer belt B. The color image formed on the intermediate transfer belt B is transported to a second transfer region Q4.

In the case of black image data only, the photoconductor drum Pk and the developing unit Gk for the black (K) color are used so that only a black toner image is formed.

After the first transfer process, residual toners on the surfaces of the photoconductor drums Py, Pm, Pc, and Pk are removed therefrom by the photoconductor cleaners CLy, CLm, CLc, and CLk.

The image bearing units Uy, Um, Uc, and Uk and the developing units Gy, Gm, Gc, and Gk constitute toner-image forming members Uy+Gy, Um+Gm, Uc+Gc, and Uk+Gk serving as an example of visible-image forming members.

A toner dispenser U3*a* serving as an example of a developer supplier is disposed above the image forming apparatus body U3. The toner dispenser U3*a* has toner cartridges Ky, Km, Kc, and Kk serving as an example of developer containers that are detachably attached thereto. As the developing units Gy to Gk consume toner in an image forming operation, the developing units Gy to Gk are supplied with toner from the respective toner cartridges Ky to Kk.

The intermediate transfer belt B disposed below the photoconductor drums Py to Pk is supported by an intermediate driving roller Rd serving as an example of an intermediate-transfer-body driving member, intermediate tension rollers Rt serving as an example of tension applying members that apply tension to the intermediate transfer belt B, an intermediate steering roller Rw serving as an example of a first deviation correcting member that corrects deviation and meandering of the intermediate transfer belt B, multiple intermediate idler rollers Rf serving as an example of driven members of the intermediate transfer body, and a backup roller T2*a* serving as an example of an opposing member disposed opposite the second transfer region Q4. The intermediate transfer belt B is supported in a rotatable manner in a direction indicated by an arrow Ya by driving of the intermediate driving roller Rd.

The intermediate driving roller Rd, the intermediate tension rollers Rt, the intermediate steering roller Rw, the intermediate idler rollers Rf, and the backup roller T2*a* serve as belt support rollers Rd+Rt+Rw+Rf+T2*a* as an example of intermediate-transfer-body support members according to the first exemplary embodiment. Furthermore, the intermediate transfer belt B, the belt support rollers Rd+Rt+Rw+Rf+T2*a*, and the first transfer rollers T1*y* to T1*k* constitute a belt module BM serving as an example of an intermediate transfer unit. The belt module BM according to the first exemplary embodiment is a replaceable unit that is detachable from the image forming apparatus body U3.

A second transfer unit Ut serving as an example of a transfer transport unit is disposed below the backup roller T2*a*. The second transfer unit Ut includes a second transfer roller T2*b* serving as an example of a transfer member and disposed facing the backup roller T2*a*. The second transfer region Q4 is formed in an area where the second transfer roller T2*b* faces the intermediate transfer belt B. In the first exemplary embodiment, the second transfer unit Ut has a bias member (not shown) that biases and presses the second transfer roller T2*b* toward the backup roller T2*a*. The backup roller T2*a* is in contact with a contact roller T2*c* serving as an example of a contact member for applying voltage. The rollers T2*a* to T2*c* constitute a second transfer device T2.

A second transfer voltage having the same polarity as the charge polarity of the toners is applied, at a predetermined timing, to the contact roller T2*c* from the power circuit E controlled by the controller C.

The sheet transport path SH2 is disposed below the belt module BM. The recording paper S fed from the feed path SH1 of the feeding device U2 is transported to the sheet transport path SH2. Then, a registration roller Rr serving as an example of a transport member transports the recording paper S to the second transfer region Q4 via sheet guides SG1 and SG2 serving as an example of medium guide members in accordance with the timing at which the toner images are to be transferred to the second transfer region Q4.

The toner images on the intermediate transfer belt B are transferred onto the recording paper S by the second transfer device T2 as the recording paper S travels through the second transfer region Q4. In the case of a full-color image, the toner images superposed and first-transferred on the surface of the intermediate transfer belt B are collectively second-transferred onto the recording paper S.

After the second transfer process, the intermediate transfer belt B is cleaned by a belt cleaner CLB serving as an example of an intermediate-transfer-body cleaner. The second transfer roller T2*b* is supported in a contactable and separable manner relative to the intermediate transfer belt B.

The first transfer rollers T1*y*, T1*m*, T1*c*, and T1*k*, the intermediate transfer belt B, the second transfer device T2, and the belt cleaner CLB constitute a transfer unit T1+B+T2+CLB that transfers the images on the surfaces of the photoconductor drums Py to Pk onto the recording paper S.

The recording paper S having the superposed toner image second-transferred thereon is transported downstream while being supported by a surface of an endless transfer transport belt T2*e* serving as an example of a transfer transport member disposed below the intermediate transfer belt B.

Multiple suction transport belts BH serving as an example of transport members that transport the recording paper S downstream while supporting the recording paper S on the surfaces thereof are disposed downstream of the transfer transport belt T2*e*. The recording paper S is transported downstream while the transport speed and the distance between the current recording paper S and the subsequent recording paper S are adjusted by the multiple suction transport belts BH. The suction transport belts BH are each provided with multiple holes (not shown). A fan serving as an example of a suction unit suctions air through the holes so that the recording paper S is transported downstream while being attached to the surfaces of the suction transport belts BH by suction. Since suction transport belts of this type are known in the related art and may be achieved by employing a freely-chosen configuration, such as a configuration discussed in Japanese Unexamined Patent Application Publication No. 2004-347880, a detailed description thereof will be omitted.

The recording paper S transported by the suction transport belts BH is transported to a fixing unit F disposed within the sheet output unit U4. The fixing unit F includes a heating roller Fh serving as an example of a thermal fixing member and a pressing roller Fp serving as an example of a pressure fixing member. A fixing region Q5 is formed in an area where the heating roller Fh and the pressing roller Fp come into contact with each other.

The toner image on the recording paper S is thermally fixed thereon by the fixing unit F as the recording paper S travels through the fixing region Q5. The recording paper S having the toner image fixed thereon in the fixing unit F is output to a sheet output tray TRh serving as an example of a sheet output section.

The paths SH1 and SH2 constitute a sheet transport path SH. The components denoted by reference characters SH, Ra, Rr, SGr, and BH constitute a medium transport unit SU.

Second Transfer Belt

Figure 2:
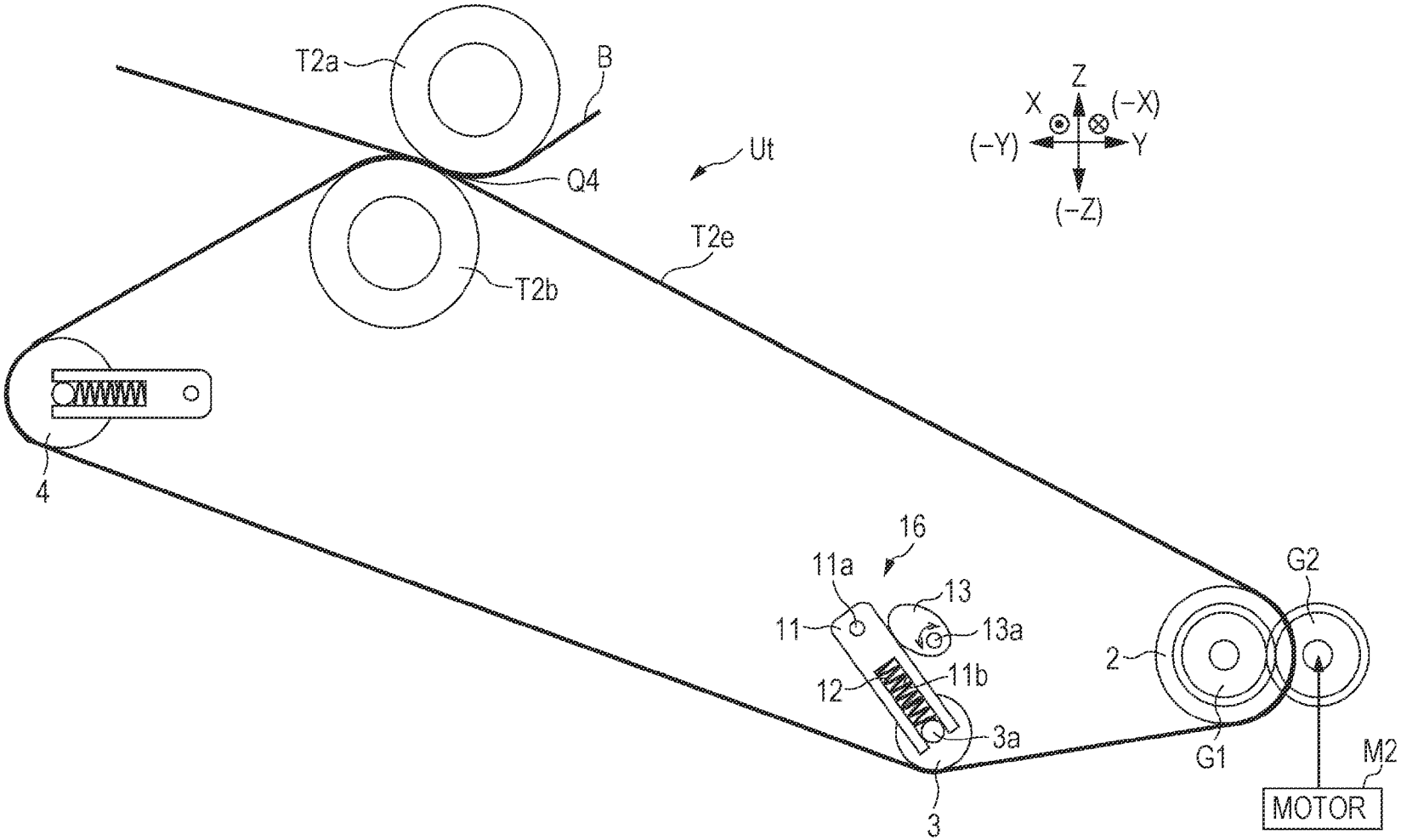
FIG. 2 illustrates a relevant part of a second transfer unit according to the first exemplary embodiment.

FIG. 2 illustrates a relevant part of the second transfer unit Ut according to the first exemplary embodiment.

Referring to FIGS. 1 and 2, the second transfer unit Ut disposed in the second transfer region Q4 has the transfer transport belt T2*e* serving as an example of an endless-belt-like transfer member that transports the recording paper S while supporting the recording paper S on the surface thereof. The transfer transport belt T2*e* is supported by the second transfer roller T2*b*, a transport driving roller 2 serving as an example of a second driving member that receives a driving force for rotating the transfer transport belt T2*e*, a transport steering roller 3 serving as an example of a second deviation correcting member that corrects deviation and meandering of the transfer transport belt T2*e*, and a transport tension roller 4 serving as an example of a second tension applying member that applies tension to the transfer transport belt T2*e*. The transport driving roller 2, the transport steering roller 3, the transport tension roller 4, and the second transfer roller T2*b* serve as transport support rollers T2*b*, 2, 3, and 4 as an example of transport-member support members according to the first exemplary embodiment.

A transmission gear G1 serving as an example of a drive transmission member is supported by an axial end of the transport driving roller 2 via a torque limiter (not shown) serving as an example of a transmission limiting member. The transmission gear G1 receives a driving force for rotating the transfer transport belt T2*e* from a transport driving motor M2 serving as an example of a driving source via an intermediate gear G2 serving as an example of an intermediate transmission member. The torque limiter, the transmission gear G1, the intermediate gear G2, and other gears (not shown) constitute a transmission system G1+G2 according to the first exemplary embodiment.

A front end of a rotation shaft 3*a* of the transport steering roller 3 is supported by a shaft support member 11. The shaft support member 11 in the first exemplary embodiment is supported by a frame (not shown) of the image forming apparatus body U3 in a rotatable manner about a rotation center 11*a* at a base end of the shaft support member 11. A terminal end of the shaft support member 11 is provided with a slit-like bias support section 11*b* that extends inward from the terminal end. The rotation shaft 3*a* of the transport steering roller 3 is supported by the terminal end of the bias support section 11*b* in a movable manner along the bias support section 11*b*. A steering bias spring 12 serving as an example of a bias member that biases the transport steering roller 3 toward the transfer transport belt T2*e* is supported within the bias support section 11*b*.

Figure 3A:
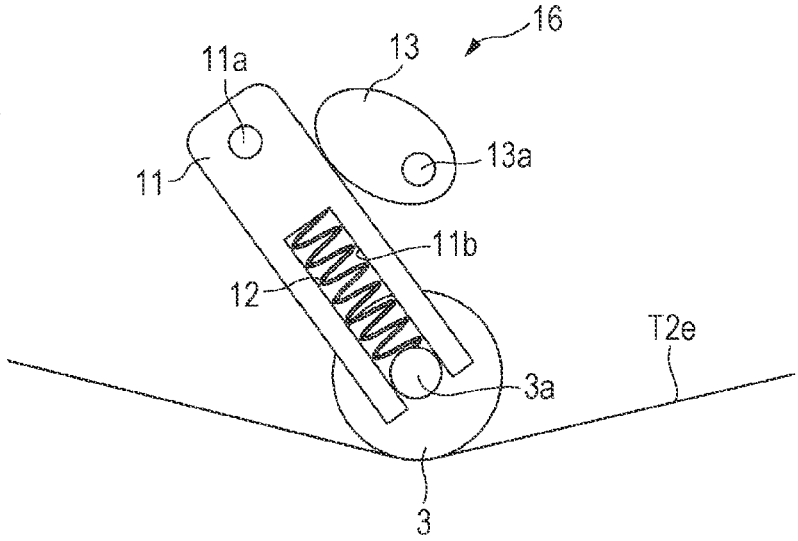
FIGS. 3A to 3C illustrate a transport steering roller according to the first exemplary embodiment, FIG. 3A illustrating a state where the transport steering roller is moved to an initial position, FIG. 3B illustrating a state where the transport steering roller is moved to a front correction position, FIG. 3C illustrating a state where the transport steering roller is moved to a rear correction position.
Figure 3B:
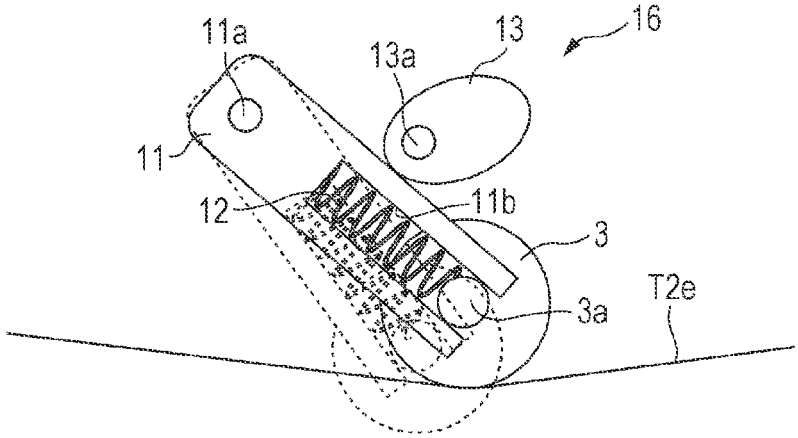
Figure 3C:
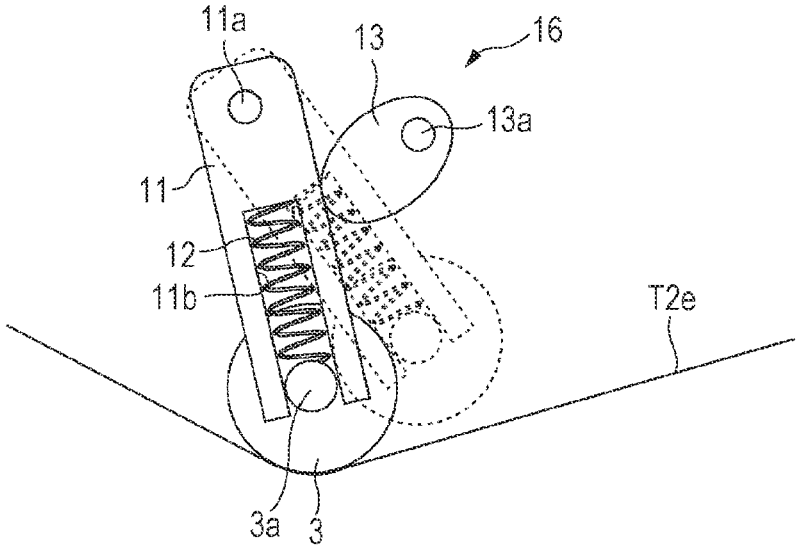

FIGS. 3A to 3C illustrate the transport steering roller 3 according to the first exemplary embodiment. Specifically, FIG. 3A illustrates a state where the transport steering roller 3 is moved to an initial position, FIG. 3B illustrates a state where the transport steering roller 3 is moved to a front correction position, and FIG. 3C illustrates a state where the transport steering roller 3 is moved to a rear correction position.

Referring to FIGS. 2 to 3C, a transport steering cam 13 serving as an example of a correction actuation member is disposed beside the shaft support member 11. The transport steering cam 13 in the first exemplary embodiment is formed of an eccentric cam. A rotation center 13*a* of the transport steering cam 13 receives a driving force from a transport steering motor 14 serving as an example of a driving source so as to be rotated in a forward or reverse direction. In the first exemplary embodiment, the shaft support member 11 receives a counterclockwise force in FIG. 3A about the rotation center 11*a* due to the tension of the transfer transport belt T2*e*, and the transport steering cam 13 is disposed downstream of the shaft support member 11 in the counterclockwise direction, which is the rotational direction of the shaft support member 11. Therefore, the shaft support member 11 is maintained in pressure contact with the transport steering cam 13 due to the force of tension from the transfer transport belt T2*e*.

Consequently, when the transport steering cam 13 rotates in the forward or reverse direction, the shaft support member 11 rotates about the rotation center 11*a*, causing the front end of the transport steering roller 3 to move relatively to the rear end thereof. Thus, the front end of the transport steering roller 3 is supported in a movable manner between the initial position shown in FIG. 3A, the front correction position shown in FIG. 3B for moving the transfer transport belt T2*e* forward if the transfer transport belt T2*e* is deviated rearward, and the rear correction position shown in FIG. 3C for moving the transfer transport belt T2*e* rearward if the transfer transport belt T2*e* is deviated forward. Therefore, by moving the front end of the transport steering roller 3 to each position, deviation and meandering of the transfer transport belt T2*e* can be corrected.

The transport steering roller 3, the shaft support member 11, the transport steering cam 13, and the transport steering motor 14 constitute a transport-belt deviation correcting mechanism 16 serving as an example of a second deviation correcting mechanism. Since a mechanism for tilting the intermediate steering roller Rw of the intermediate transfer belt B is similar to the transport-belt deviation correcting mechanism 16, a detailed description thereof will be omitted.

Figure 4:
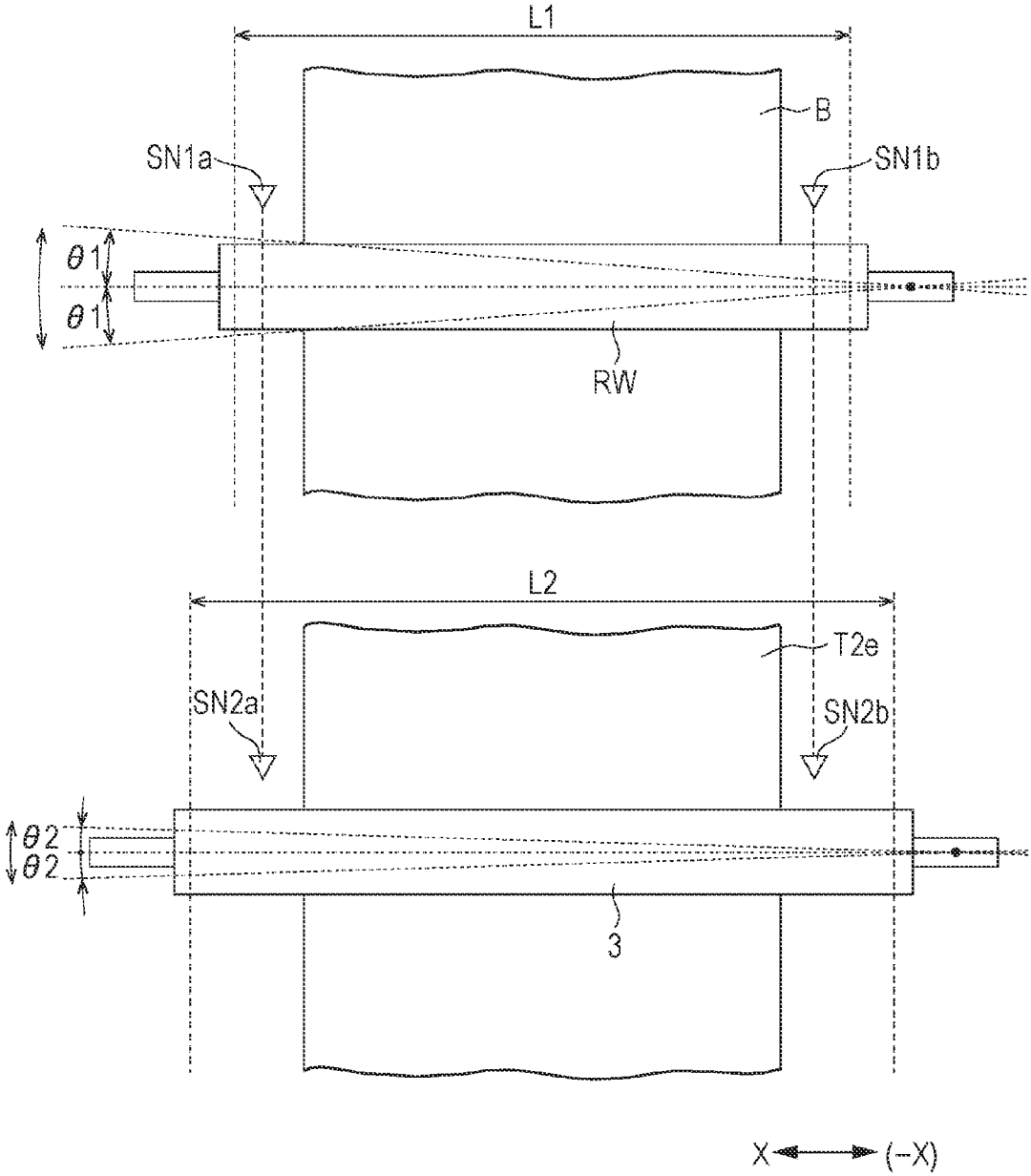
FIG. 4 illustrates positional relationships among an intermediate transfer belt, an intermediate steering roller, a transfer transport belt, and the transport steering roller according to the first exemplary embodiment in the belt-width direction.

FIG. 4 illustrates positional relationships among the intermediate transfer belt B, the intermediate steering roller Rw, the transfer transport belt T2*e*, and the transport steering roller 3 according to the first exemplary embodiment in the belt-width direction.

Referring to FIG. 4, a first movable range L1 within which the intermediate transfer belt B according to the first exemplary embodiment is movable in the width direction relative to the axial direction of the intermediate steering roller Rw is preliminarily set in accordance with the design. A first detection member SN1 having a first front detection sensor SN1*a* that can detect a front end of the intermediate transfer belt B in the width direction and a first rear detection sensor SN1*b* that can detect a rear end thereof is disposed within the first movable range L1.

A second movable range L2 within which the transfer transport belt T2*e* according to the first exemplary embodiment is movable in the width direction relative to the axial direction of the transport steering roller 3 is set to be wider than the first movable range L1. Specifically, in the first exemplary embodiment, the relationship L2>L1 is set such that the transfer transport belt T2*e* has a wider permissible movable range in the width direction relative to the intermediate transfer belt B. A second detection member SN2 having a second front detection sensor SN2*a* that can detect a front end of the transfer transport belt T2*e* in the width direction and a second rear detection sensor SN2*b* that can detect a rear end thereof is disposed within the second movable range L2.

Referring to FIG. 4, in the first exemplary embodiment, a first tilt angle θ1 relative to the initial position when the intermediate steering roller Rw is moved to the front correction position or the rear correction position is set to be larger than a second tilt angle θ2 relative to the initial position when the transport steering roller 3 is moved to the front correction position or the rear correction position. Specifically, in the first exemplary embodiment, the relationship θ1>θ2 is set. Therefore, in the first exemplary embodiment, an amount by which the intermediate transfer belt B is moved per unit time in the width direction, that is, forward or rearward, by the intermediate steering roller Rw when moved to the front correction position or the rear correction position is set to be larger than that of the transport steering roller 3.

For example, in the first exemplary embodiment, θ1 is set equal to 5°, and θ2 is set equal to 1.25°, and the amount of movement per unit time, that is, steering sensitivity, is set to 0.4 mm for the intermediate transfer belt B and to 0.2 mm for the transfer transport belt T2*e*. The specific numerical values for the aforementioned angles and the amounts of movement of the belts are not limited to the aforementioned values, and may be changed to freely-chosen values depending on perimeters and rotational speeds of the belts, roller diameters, and cam shapes. In the first exemplary embodiment of the present invention, the relationship θ1≤θ2 may alternatively be set so long as the steering sensitivity of the intermediate transfer belt B is set to be larger than the steering sensitivity of the transfer transport belt T2*e*.

Controller in First Exemplary Embodiment

FIG. 5 is a functional diagram, that is, a block diagram, of the controller C of the image forming apparatus U according to the first exemplary embodiment of the present invention.

Referring to FIG. 5, the controller C includes an input-output interface I/O that exchanges signals with an external source, a read-only memory (ROM) that stores information and a program used for performing processing, a random access memory (RAM) for temporarily storing data, a central processing unit (CPU) that performs the processing according to the program stored in the ROM, and a small-size information processor, that is, a micro-computer, having an oscillator, and achieves various functions by executing the program stored in the ROM.

Signal Output Components Connected to Controller C

The controller C receives output signals from signal output components, such as the operating section UI, the first front detection sensor SN1*a*, the first rear detection sensor SN1*b*, the second front detection sensor SN2*a*, and the second rear detection sensor SN2*b*.

The operating section UI includes a power button UI1, a display UI2, and an arrow key UI3 and a setting key UI4 serving as examples of input keys.

The first front detection sensor SN1*a* detects the front end of the intermediate transfer belt B in the width direction.

The first rear detection sensor SN1*b* detects the rear end of the intermediate transfer belt B in the width direction.

The second front detection sensor SN2*a* detects the front end of the transfer transport belt T2*e* in the width direction.

The second rear detection sensor SN2*b* detects the rear end of the transfer transport belt T2*e* in the width direction.

Each of the detection sensors SN1*a* to SN2*b* in the first exemplary embodiment outputs a detection signal to the controller C at predetermined time intervals of, for example, 0.5 seconds.

Control Components Connected to Controller C

The controller C is connected to a driving-source driving circuit D0, an intermediate-steering-motor driving circuit D1, a transport-steering-motor driving circuit D2, the power circuit E, and other control components (not shown), and outputs actuation control signals thereto.

The driving-source driving circuit D0 rotationally drives the photoconductor drums Py to Pk and the intermediate transfer belt B via a motor M0 serving as an example of a driving source.

The intermediate-steering-motor driving circuit D1 moves the intermediate steering roller Rw between the initial position, the front correction position, and the rear correction position via an intermediate steering motor M1.

The transport-steering-motor driving circuit D2 moves the transport steering roller 3 between the initial position, the front correction position, and the rear correction position via the transport steering motor 14.

The power circuit E includes a development power circuit Ea, a charge power circuit Eb, a transfer power circuit Ec, and a fixation power circuit Ed.

The development power circuit Ea applies development voltage to the developing rollers RO of the developing units Gy to Gk.

The charge power circuit Eb applies charge voltage to the corotron members CCy to CCk so as to charge the surfaces of the photoconductor drums Py to Pk.

The transfer power circuit Ec applies transfer voltage to the first transfer rollers T1*y* to T1*k* and the second transfer roller T2*b*.

The fixation power circuit Ed supplies power for heating the heating roller Fh of the fixing unit F.

Function of Controller C

The controller C has a function of executing processing according to input signals from the signal output components and outputting control signals to the control components. Specifically, the controller C has the following functions.

C1: Job Control Section

A job control section C1 serving as an example of an image-forming-operation control section controls the driving and voltage applying timings for the components in the image forming apparatus U in accordance with an input from the operating section UI so as to execute a job as an example of image forming operation.

C2: Motor Control Section

A motor control section C2 serving as an example of a driving-source control section controls the driving of the motor M0 via the motor driving circuit D0 so as to control the driving of the photoconductor drums Py to Pk.

C3: Power Control Section

A power control section C3 includes a development power control section C3A, a charge power control section C3B, a transfer power control section C3C, and a fixation power control section C3D, and controls the operation of the power circuit E so as to control the voltage applied and the power supplied to the components.

C3A: Development Power Control Section

The development power control section C3A controls the development power circuit Ea so as to control the development voltage applied to the developing rollers RO of the developing units Gy to Gk.

C3B: Charge Power Control Section

The charge power control section C3B controls the charge power circuit Eb so as to control the charge voltage applied to the corotron members CCy to CCk.

C3C: Transfer Power Control Section

The transfer power control section C3C controls the transfer power circuit Ec so as to control first transfer voltage applied to the first transfer rollers T1*y* to T1*k* and second transfer voltage applied to the second transfer roller T2*b*.

C3D: Fixation Power Control Section

The fixation power control section C3D controls the fixation power circuit Ed so as to control the temperature of a heater for the heating roller Fh of the fixing unit F. In other words, the fixation power control section C3D controls the fixation temperature.

C4: First Correction Control Section

A first correction control section C4 includes an intermediate-transfer-belt deviation determining section C4A serving as an example of a first deviation determining section, an intermediate-steering-roller tilt-direction determining section C4B serving as an example of a first tilt-direction determining section, an intermediate-steering-roller tilt control section C4C serving as an example of a first tilt control section, and an intermediate-steering-roller position storing section C4D serving as an example of a first position storing section. In a case where the first detection member SN1 detects deviation of the intermediate transfer belt B, the first correction control section C4 tilts the intermediate steering roller Rw in a direction for correcting the deviation of the intermediate transfer belt B so as to correct the deviation.

C4A: Intermediate-Transfer-Belt Deviation Determining Section

The intermediate-transfer-belt deviation determining section C4A detects deviation of the intermediate transfer belt B on the basis of a detection result of the first detection member SN1. The intermediate-transfer-belt deviation determining section C4A in the first exemplary embodiment detects whether the intermediate transfer belt B is deviated forward or rearward or whether the intermediate transfer belt B is not deviated on the basis of detection results of the first front detection sensor SN1*a* and the first rear detection sensor SN1*b*.

C4B: Intermediate-Steering-Roller Tilt-Direction Determining Section

The intermediate-steering-roller tilt-direction determining section C4B determines the tilt direction of the intermediate steering roller Rw on the basis of the determination result of the intermediate-transfer-belt deviation determining section C4A. If it is determined that the intermediate transfer belt B is deviated forward, the intermediate-steering-roller tilt-direction determining section C4B in the first exemplary embodiment determines that the intermediate steering roller Rw should be tilted toward the front correction position. If it is determined that the intermediate transfer belt B is deviated rearward, the intermediate-steering-roller tilt-direction determining section C4B determines that the intermediate steering roller Rw should be tilted toward the rear correction position. If it is determined that the intermediate transfer belt B is not deviated, the intermediate-steering-roller tilt-direction determining section C4B determines that the intermediate steering roller Rw should be moved to the initial position.

C4C: Intermediate-Steering-Roller Tilt Control Section

The intermediate-steering-roller tilt control section C4C controls the tilting of the intermediate steering roller Rw via the intermediate-steering-motor driving circuit D1. The intermediate-steering-roller tilt control section C4C in the first exemplary embodiment causes the intermediate steering roller Rw to move to the initial position, the front correction position, or the rear correction position on the basis of the determination result of the intermediate-steering-roller tilt-direction determining section C4B.

C4D: Intermediate-Steering-Roller Position Storing Section

The intermediate-steering-roller position storing section C4D stores the current position of the intermediate steering roller Rw moved by the intermediate-steering-roller tilt control section C4C.

C5: Second Correction Control Section

A second correction control section C5 includes a transfer-transport-belt deviation determining section C5A serving as an example of a second deviation determining section, a transport-steering-roller tilt-direction determining section C5B serving as an example of a second tilt-direction determining section, a transport-steering-roller tilt control section C5C serving as an example of a second tilt control section, and a transport-steering-roller position storing section C5D serving as an example of a second position storing section. In a case where the second detection member SN2 detects deviation of the transfer transport belt T2*e*, the second correction control section C5 tilts the transport steering roller 3 in a direction for correcting the deviation of the transfer transport belt T2*e* so as to correct the deviation.

Because the sections C5A to C5D are similar to the aforementioned sections C4A to C4D except for the fact that the intermediate transfer belt B is replaced by the transfer transport belt T2*e* and the intermediate steering roller Rw is replaced by the transport steering roller 3, detailed descriptions thereof will be omitted for the sake of convenience.

Flowchart of First Exemplary Embodiment

Next, the flow of control performed in the image forming apparatus U according to the first exemplary embodiment will be described with reference to a flowchart.

Flowchart of Deviation Correcting Process

Figure 6:
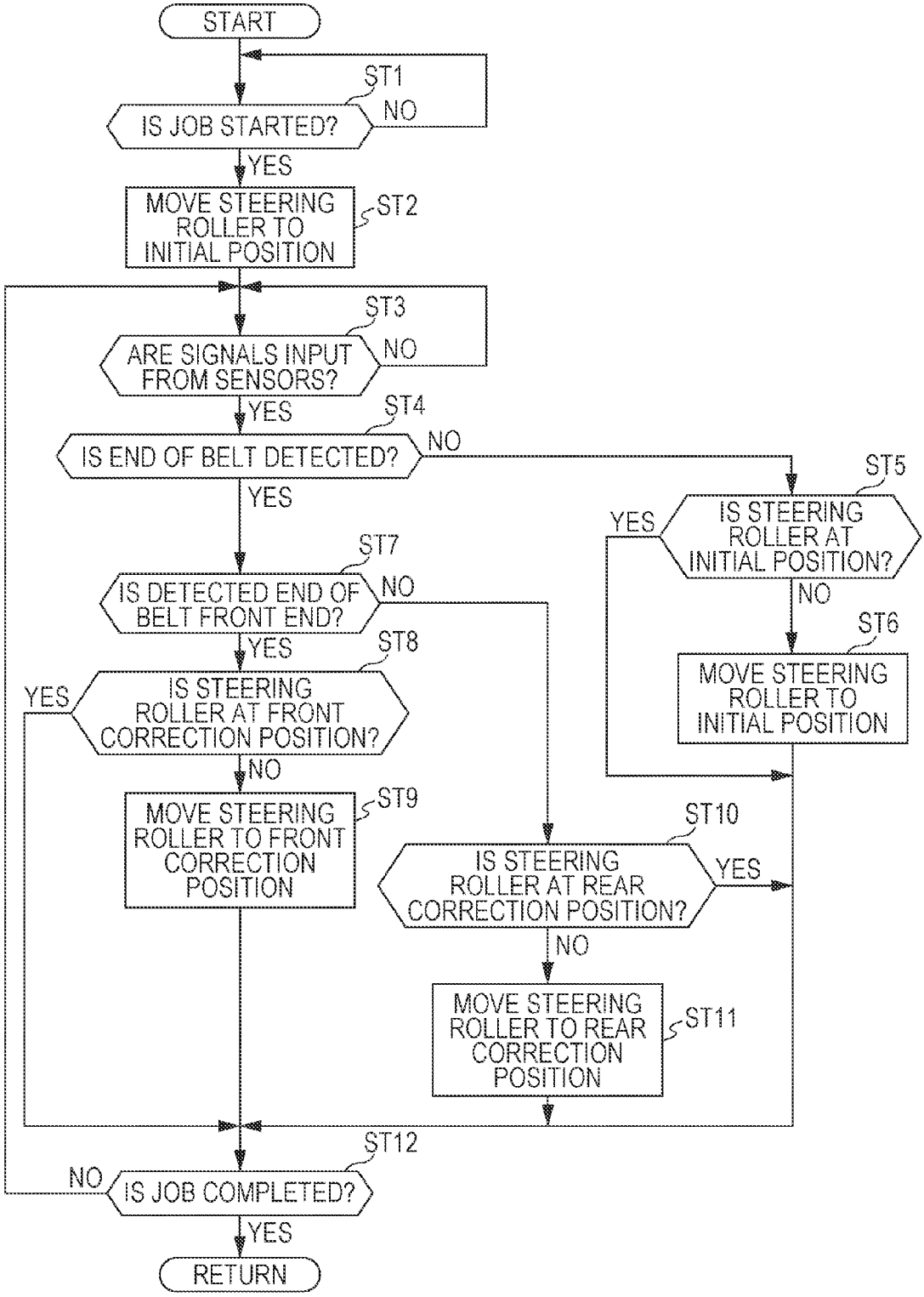
FIG. 6 is a flowchart of a deviation correcting process according to the first exemplary embodiment.

FIG. 6 is a flowchart of a deviation correcting process according to the first exemplary embodiment.

Steps ST in the flowchart in FIG. 6 are performed in accordance with a program stored in the controller C of the image forming apparatus U. Furthermore, this process is performed simultaneously with various kinds of processes performed in the image forming apparatus U. Although FIG. 6 is directed to a description of a process related to the intermediate steering roller Rw, since a process related to the transport steering roller 3 is performed similarly and simultaneously therewith, a detailed description thereof will be omitted.

The flowchart shown in FIG. 6 commences as the power of the image forming apparatus U is turned on.

In step ST1 in FIG. 6, it is determined whether or not a job is started. If yes, the process proceeds to step ST2. If no, step ST1 is repeated.

In step ST2, the intermediate steering roller Rw is moved to the initial position. The process then proceeds to step ST3.

In step ST3, it is determined whether or not signals are input from the sensors SN1*a* and SN1*b*. If yes, the process proceeds to step ST4. If no, step ST3 is repeated.

In step ST4, it is determined whether or not an end of the intermediate transfer belt B is detected. Specifically, it is detected whether or not one of the sensors SN1*a* and SN1*b* has detected an end of the intermediate transfer belt B. If yes, the process proceeds to step ST7. If no, the process proceeds to step ST5.

In step ST5, it is determined whether or not the current position of the intermediate steering roller Rw is the initial position. If no, the process proceeds to step ST6. If yes, the process proceeds to step ST12.

In step ST6, the intermediate steering motor M1 is actuated so as to move the intermediate steering roller Rw to the initial position. The process then proceeds to step ST12.

In step ST7, it is determined whether or not the detected end of the intermediate transfer belt B is the front end. If yes, the process proceeds to step ST8. If no, the process proceeds to step ST10.

In step ST8, it is determined whether or not the current position of the intermediate steering roller Rw is the front correction position. If no, the process proceeds to step ST9. If yes, the process proceeds to step ST12.

In step ST9, the intermediate steering motor M1 is actuated so as to move the intermediate steering roller Rw to the front correction position. The process then proceeds to step ST12.

In step ST10, it is determined whether or not the current position of the intermediate steering roller Rw is the rear correction position. If no, the process proceeds to step ST11. If yes, the process proceeds to step ST12.

In step ST11, the intermediate steering motor M1 is actuated so as to move the intermediate steering roller Rw to the rear correction position. The process then proceeds to step ST12.

In step ST12, it is determined whether or not the job is completed. If no, the process returns to step ST3. If yes, the process returns to step ST1.

Operation of First Exemplary Embodiment

In the image forming apparatus U according to the first exemplary embodiment having the above-described configuration, the toner images formed on the photoconductor drums Py to Pk are superposed and transferred onto the recording paper S in the second transfer region Q4 via the intermediate transfer belt B. The recording paper S having the superposed toner image transferred thereon is transported downstream while being supported on the surface of the transfer transport belt T2*e*, and is then transported to the suction transport belts BH. Subsequently, the toner image is fixed onto the recording paper S by the fixing unit F before the recording paper S is output to the sheet output tray TRh.

In the first exemplary embodiment, if the intermediate transfer belt B is deviated, the deviation is detected by the first detection member SN1, and the intermediate steering roller Rw is tilted, thereby correcting the deviation. If the transfer transport belt T2*e* is deviated, the deviation is detected by the second detection member SN2, and the transport steering roller 3 is tilted, thereby correcting the deviation.

In the configuration in which the two belts B and T2*e* are in contact with each other in the second transfer region Q4, the direction of deviation and the direction for correcting the deviation are sometimes opposite to each other. This may make it difficult to correct the deviation of the belts B and T2*e*, possibly resulting in instable rotation of the belts B and T2*e*. If images are transferred onto the intermediate transfer belt B from the photoconductor drums Py to Pk in this state, the image quality may possibly be reduced, such as the occurrence of color misregistration.

In the related art discussed in Japanese Unexamined Patent Application Publication No. 2009-251322, if the deviation is moderate, one of the belts with the larger deviation is corrected for the deviation, while the deviation correcting process is stopped for the other belt. However, while the correcting process is performed for the first belt, the deviation of the second belt increases. This deviation tends to increase especially when the image forming rate is high. Therefore, the correction process is performed by printing a so-called patch image, which is a correction image used for correcting color misregistration in a printed image, resulting in lower productivity.

In the technology discussed in Japanese Unexamined Patent Application Publication No. 2009-251322, if the deviation becomes large, the belts are moved away from each other so as to perform the deviation correcting process individually for the belts. However, with this configuration, image forming operation cannot be performed during the deviation correcting process, resulting in very low productivity.

In particular, in the configuration in which the two belts are in contact with each other in the related art, an already available device and proven numerical values are often used for preventing the deviation of the belts. In addition, the steering sensitivities of the belts are not set to different values but are generally set to the same value.

In contrast, in the first exemplary embodiment, the amount by which the intermediate transfer belt B is moved per unit time in the width direction, that is, the steering sensitivity thereof, is set to be larger than the steering sensitivity of the transfer transport belt T2*e*. Therefore, the deviation correcting process for the intermediate transfer belt B and the deviation correcting process for the transfer transport belt T2*e* are performed simultaneously. Moreover, when the belts B and T2*e* are moving in opposite directions, the intermediate transfer belt B moves predominantly so that the deviation correcting process for the intermediate transfer belt B is prioritized.

With regard to the images transferred onto the intermediate transfer belt B from the photoconductor drums Py to Pk, although deviation and meandering of the intermediate transfer belt B may possibly have an adverse effect on the images, such as color misregistration, expansion and contraction, and skewing, an effect the transfer transport belt T2*e* has on the transport of the recording paper S is small even if the transfer transport belt T2*e* is deviated in the width direction. Therefore, in the first exemplary embodiment, the steering sensitivity of the intermediate transfer belt B is set to be larger than that of the transfer transport belt T2*e*, thereby reducing the occurrence of reduced image quality, such as color misregistration.

EXPERIMENTAL EXAMPLE

Figure 7:
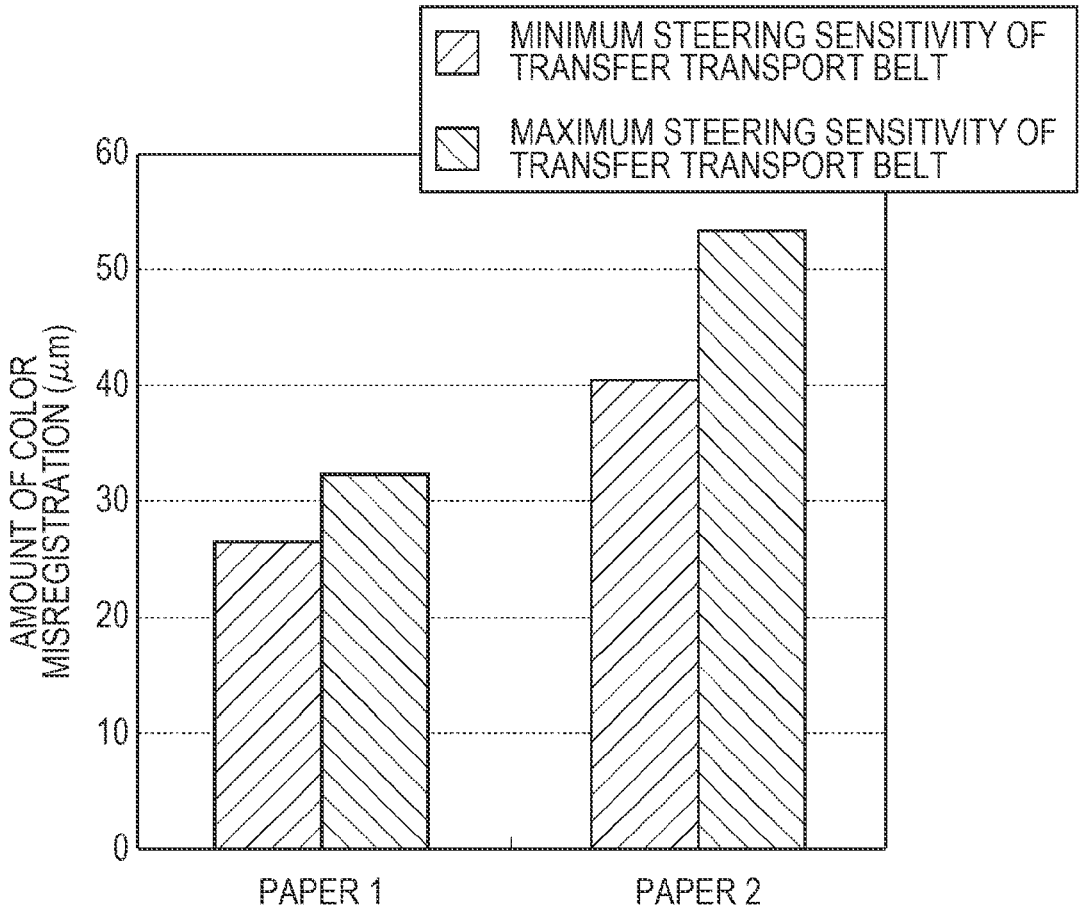
FIG. 7 illustrates an experimental example and is a graph in which a horizontal axis denotes the types of paper used in the experiment and a vertical axis denotes the amount of color misregistration.

FIG. 7 illustrates an experimental example and is a graph in which a horizontal axis denotes the types of paper used in the experiment and a vertical axis denotes the amount of color misregistration.

Experiments related to the occurrence of color misregistration are performed. The experiments are performed using a remodeled version of Color 1000 Press manufactured by Fuji Xerox Co., Ltd. The types of paper used in the experiments include plain paper with a basis weight of 82 g/m$^2$ as "paper 1" and coated paper with a basis weight of 127 g/m$^2$ as "paper 2". A first experiment corresponds to a case where the steering sensitivity of the transfer transport belt T2*e* is set to be smaller than the steering sensitivity of the intermediate transfer belt B, and a second experiment corresponds to a case where the transfer transport belt T2*e* is set to be larger than the steering sensitivity of the intermediate transfer belt B. In each experiment, a maximum color misregistration value of Y, M, and C images relative to a K image is measured as an amount of color misregistration (μm). The experimental results are shown in FIG. 7.

Referring to FIG. 7, with regard to both paper 1 and paper 2, when the steering sensitivity of the transfer transport belt T2*e* is smaller, that is, when the configuration according to the first exemplary embodiment is used, it is confirmed that the amount of color misregistration is smaller than when the steering sensitivity of the transfer transport belt T2*e* is larger.

Furthermore, in the first exemplary embodiment, although there is a possibility that, when the intermediate transfer belt B is being corrected for deviation, deviation of the transfer transport belt T2*e* may increase due to clogging of the deviation correcting process for the transfer transport belt T2*e*, the second movable range L2 is set to be larger than the first movable range L1, meaning that the transfer transport belt T2*e* is given a larger permissible movable amount. In particular, with regard to the transfer transport belt T2*e* disposed in the second transfer region Q4 where images are collectively transferred, the permissible movable amount thereof relative to color misregistration may have lower accuracy as compared with that of the intermediate transfer belt B to which images are sequentially transferred from the four photoconductor drums Py to Pk. Thus, the transfer transport belt T2*e* may have a large permissible movable amount.

Therefore, with the transfer transport belt T2*e* given a large permissible movable amount, even when the transfer transport belt T2*e* is largely deviated, the deviation tends to be within the second movable range L2. Thus, the occurrence of breakage or fracturing of the ends of the transfer transport belt T2*e* caused by excessive deviation of the transfer transport belt T2*e* is reduced, as compared with a case where the second movable range L2 is smaller.

Furthermore, in the first exemplary embodiment, the transport driving roller 2 of the transfer transport belt T2*e* is provided with the torque limiter. In a case where a torque limiter is not provided, if the speed varies between the transfer transport belt T2*e* and the intermediate transfer belt B, the rotational force of the transfer transport belt T2*e* may be transmitted to the intermediate transfer belt B and affect the behavior of the intermediate transfer belt B, such as deviation thereof, possibly affecting the image quality. In contrast, with the transfer transport belt T2*e* provided with the torque limiter in the first exemplary embodiment, if a preset driving force, that is, a driving force greater than or equal to torque, is generated in the transport driving roller 2, the transmission of torque is limited so that the rotation of the transfer transport belt T2*e* is limited. Therefore, the intermediate transfer belt B is less likely to receive an excessive load from the transfer transport belt T2*e* so that an adverse effect on the rotation of the intermediate transfer belt B is reduced, as compared with a case where a torque limiter is not provided, thereby reducing an adverse effect on the image quality.

Modifications

Although the exemplary embodiments of the present invention have been described in detail above, the present invention is not to be limited to the above exemplary embodiments and permits various modifications within the scope of the invention defined in the claims. Modifications H01 to H08 of the above exemplary embodiments of the present invention will be described below.

In a first modification H01 of the above exemplary embodiments, the image forming apparatus U is not limited to a copier, and may be applied to other types of image forming apparatuses, such as a printer, a facsimile apparatus, or a multifunction apparatus equipped with these multiple functions. Furthermore, the above exemplary embodiments are not limited to a color image forming apparatus, and may be applied to a monochrome image forming apparatus. Furthermore, the above exemplary embodiments are not limited to a so-called tandem-type image forming apparatus provided with the photoconductor drums Py to Pk for the four respective colors, and may be applied to a so-called rotary-type image forming apparatus that performs a developing process by rotating multiple developing units so as to sequentially make them face a single photoconductor drum, or to a so-called retracting-type image forming apparatus in which multiple developing units are supported in a movable manner toward and away from a single photoconductor drum such that a developing process is performed by moving the developing units toward the photoconductor drum.

In a second modification H02, although drum-like photoconductors are described as an example of image bearing members in the above exemplary embodiments, an endless-belt-like photoconductor may be used as an alternative. Specifically, the above exemplary embodiments are applicable to a configuration having an endless-belt-like photoconductor and an endless transfer transport belt or to a configuration having an endless-belt-like photoconductor and an endless intermediate transfer belt.

In a third modification H03, the specific numerical values and materials used in the above exemplary embodiments are changeable in accordance with the design and specifications.

In a fourth modification H04, the number and positions of rollers T2*b* and 2 to 4 in the above exemplary embodiments are changeable in accordance the design and specifications.

Although the transport steering roller 3 and the transport tension roller 4 are disposed at different positions in the above exemplary embodiments, a fifth modification H05 in which the transport tension roller 4 and the transport steering roller 3 are integrated into a single unit by adding the function of the transport steering roller 3 to the transport tension roller 4 is also possible.

In a sixth modification H06, although the torque limiter is provided in the above exemplary embodiments, the torque limiter may be omitted if the friction coefficient of the belts is low to an extent that the rotational force of the transfer transport belt T2*e* is hardly transmitted to the intermediate transfer belt B.

In a seventh modification H07, the deviation correcting mechanism used for tilting the steering rollers Rw and 3 in the above exemplary embodiments is not limited to the configuration described in the above exemplary embodiments, and a freely-chosen active steering mechanism known in the related art may be employed so long as the steering sensitivity is within the range defined in the exemplary embodiments of the present invention. For example, various known configurations discussed in Japanese Unexamined Patent Application Publication Nos. 2009-86463, 2010-231112, 2009-251322, and 2007-11107 may be employed.

In an eighth modification H08, although the second movable range L2 is set to be greater than the first movable range L1 in the above exemplary embodiments, the second movable range L2 may be changed in accordance with the limit of deviation of the transfer transport belt T2*e*. For example, if the transfer transport belt T2*e* does not experience much deviation, the second movable range L2 may be set to be smaller than the first movable range L1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an endless-belt-like image bearing member that rotates while bearing a visible image on a surface thereof;

an endless-belt-like transport member that is disposed in a transfer region where the visible image on the surface of the image bearing member is transferred onto a medium and that transports the medium while supporting the medium on a surface of the transport member;

a transfer member that rotatably supports the endless-belt-like transport member and that is disposed in the transfer region so as to face the image bearing member with the endless-belt-like transport member interposed therebetween, wherein transfer voltage used for transferring the visible image on the surface of the image bearing member onto the medium is applied between the transfer member and the image bearing member;

a first detection member that detects deviation of the endless-belt-like image bearing member in a width direction thereof;

a first deviation correcting member that extends in the width direction of the endless-belt-like image bearing member and that is supported in a tiltable manner relative to the width direction, the first deviation correcting member supporting the endless-belt-like image bearing member;

a first correction control section that tilts the first deviation correcting member in a direction for correcting deviation of the image bearing member, if the first detection member detects that the image bearing member is deviated, so as to correct the deviation;

a second detection member that detects deviation of the endless-belt-like transport member in a width direction thereof;

a second deviation correcting member that extends in the width direction of the endless-belt-like transport member and that is supported in a tiltable manner relative to the width direction, the second deviation correcting member supporting the endless-belt-like transport member; and a second correction control section that tilts the second deviation correcting member in a direction for correcting deviation of the transport member, if the second detection member detects that the transport member is deviated, so as to correct the deviation, wherein an amount by which the image bearing member is moved per unit time in the width direction when the first deviation correcting member is tilted is set to be larger than an amount by which the transport member is moved per unit time in the width direction when the second deviation correcting member is tilted.

2. The image forming apparatus according to claim 1, wherein a second movable range within which the transport member is movable in the width direction is set to be wider than a first movable range within which the image bearing member is movable in the width direction.

3. The image forming apparatus according to claim 2, further comprising:

a driving member that supports the transport member and that rotates the transport member; and a transmission system that transmits a rotational force to the driving member and that limits the transmission of the rotational force relative to the driving member if a driving force greater than or equal to a preset driving force is set for the driving member.

4. The image forming apparatus according to claim 1, further comprising:

a driving member that supports the transport member and that rotates the transport member; and a transmission system that transmits a rotational force to the driving member and that limits the transmission of the rotational force relative to the driving member if a driving force greater than or equal to a preset driving force is set for the driving member.

* * * * *